US010354827B2

(12) United States Patent
Jeong et al.

(10) Patent No.: US 10,354,827 B2
(45) Date of Patent: Jul. 16, 2019

(54) ELECTRON EMISSION SOURCE AND METHOD FOR FABRICATING THE SAME

(71) Applicant: ELECTRONICS AND TELECOMMUNICATIONS RESEARCH INSTITUTE, Daejeon (KR)

(72) Inventors: Jin-Woo Jeong, Daejeon (KR); Yoon-Ho Song, Daejeon (KR)

(73) Assignee: ELECTRONICS & TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 15/697,272

(22) Filed: Sep. 6, 2017

(65) Prior Publication Data

US 2018/0211806 A1 Jul. 26, 2018

(30) Foreign Application Priority Data

Jan. 25, 2017 (KR) ..... 10-2017-0012283

(51) Int. Cl.
*H01J 1/304* (2006.01)
*H01J 19/24* (2006.01)
*H01J 9/02* (2006.01)

(52) U.S. Cl.
CPC ..... *H01J 1/304* (2013.01); *H01J 9/025* (2013.01); *H01J 19/24* (2013.01)

(58) Field of Classification Search
None
See application file for complete search history.

(56) References Cited

U.S. PATENT DOCUMENTS

| | | | | |
|---|---|---|---|---|
| 6,307,323 | B1 | 10/2001 | Song et al. | |
| 6,472,802 | B1 | 10/2002 | Choi et al. | |
| 6,648,712 | B2 | 11/2003 | Choi et al. | |
| 7,652,418 | B2 * | 1/2010 | Choi | B82Y 10/00 313/306 |
| 8,016,633 | B2 | 9/2011 | Jiang et al. | |
| 8,371,892 | B2 | 2/2013 | Wei et al. | |
| 2003/0001478 | A1 * | 1/2003 | Ezaki | B82Y 10/00 313/313 |
| 2007/0018553 | A1 * | 1/2007 | Cho | H01J 1/304 313/311 |
| 2007/0024177 | A1 * | 2/2007 | Choi | B82Y 10/00 313/495 |
| 2013/0214244 | A1 * | 8/2013 | Sanborn | H01J 1/304 257/10 |
| 2014/0111081 | A1 | 4/2014 | Jeong et al. | |
| 2015/0146865 | A1 | 5/2015 | Kim et al. | |

* cited by examiner

*Primary Examiner* — Ashok Patel

(57) ABSTRACT

Provided is an electron emission source including a substrate, a fixed structure provided on the substrate, and an electron emission yarn provided between the substrate and the fixed structure. The fixed structure includes a first portion having a first width and a second portion having a second width greater than the first width, and the electron emission yarn extends on a first sidewall of the first portion of the fixed structure from between the fixed structure and the substrate.

10 Claims, 9 Drawing Sheets

ELECTRON EMISSION SOURCE AND METHOD FOR FABRICATING THE SAME

CROSS-REFERENCE TO RELATED APPLICATIONS

This U.S. non-provisional patent application claims priority under 35 U.S.C. § 119 of Korean Patent Application No. 10-2017-0012283, filed on Jan. 25, 2017, the entire contents of which are hereby incorporated by reference.

BACKGROUND

The present disclosure herein relates to an electron emission source and a method of fabricating the same, and more particularly, to an electron emission source having improved stability and a method for fabricating the same with improved process efficiency.

Nanomaterial (e.g., carbon nanotube) yarn has a thread-like shape obtained by coupling nanomaterials. Nanomaterial yarns may be formed thin and long. Nanomaterial yarns may generate current steadily. For example, one strand of carbon nanotube yarn may stably generate a field emission current of 1 mA or more. Therefore, when nanomaterial yarns are arranged in an array form, it is possible to manufacture an electron emission source having a high current density. Nanomaterial yarns may emit electrons within an electric field. It is required that nanomaterial yarns maintain its stability in a high electric field.

SUMMARY

The present disclosure is to improve the stability of an electron emission source.

The present disclosure also is to provide a method for easily manufacturing an array of electron emission yarns.

An embodiment of the inventive concept provides an electron emission source including: a substrate; a fixed structure provided on the substrate; and an electron emission yarn provided between the substrate and the fixed structure, wherein the fixed structure includes a first portion having a first width and a second portion having a second width greater than the first width, and the electron emission yarn extends on a first sidewall of the first portion of the fixed structure from between the fixed structure and the substrate.

In an embodiment, the electron emission yarn may protrude from an upper surface of the fixed structure.

In an embodiment, the electron emission yarn may protrude by several nanometers to several micrometers from the upper surface of the fixed structure.

In an embodiment, the electron emission yarn may extend in a direction perpendicular to the upper surface of the substrate.

In an embodiment, the first portion of the fixed structure may include a second sidewall facing an opposite direction to the first sidewall, and the electron emission yarn may extend on the second sidewall from between the fixed structure and the substrate.

In an embodiment, the electron emission yarn may be provided in plurality, and end portions of the plurality of electron emission yarns may have the same heights.

In an embodiment, the first and second portions of the fixed structure may be provided in plurality, and the plurality of first and second portions may be alternately arranged in a first direction parallel to an upper surface of the substrate.

In an embodiment, the fixed structure may be provided in plurality, and the plurality of fixed structures may be parallel to the upper surface of the substrate and are arranged in a second direction intersecting the first direction.

In an embodiment, the electron emission source may further include support structures provided on a side surface of each of fixed structures disposed outmost along the second direction among the plurality of fixed structures, wherein the support structures may be arranged in the second direction together with the plurality of fixed structures.

In an embodiment, an end portion of the electron emission yarn may be disposed lower than an upper surface of the fixed structure.

In an embodiment of the inventive concept, an electron emission source manufacturing method includes: preparing a fixed structure; forming an electron emission yarn extending along a first sidewall, a bottom surface, and a second sidewall of the fixed structure on the fixed structure; and fixing the fixed structure on a substrate, wherein the electron emission yarn is fixed between the fixed structure and the substrate.

In an embodiment, the forming of the electron emission yarn may include: winding the fixed structure with a preliminary electron emission yarn; and cutting the preliminary electron emission yarn on an upper surface of the fixed structure.

In an embodiment, the cutting of the preliminary electron emission yarn may include performing cutting in a first direction parallel to an upper surface of the substrate along a center of the upper surface of the fixed structure.

In an embodiment, the cutting of the preliminary electron emission yarn may include performing cutting in a first direction parallel to an upper surface of the substrate along a plurality of cutting lines on the upper surface of the fixed structure.

In an embodiment, the method may further include removing the cut preliminary electron emission yarn on the upper surface of the fixed structure.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
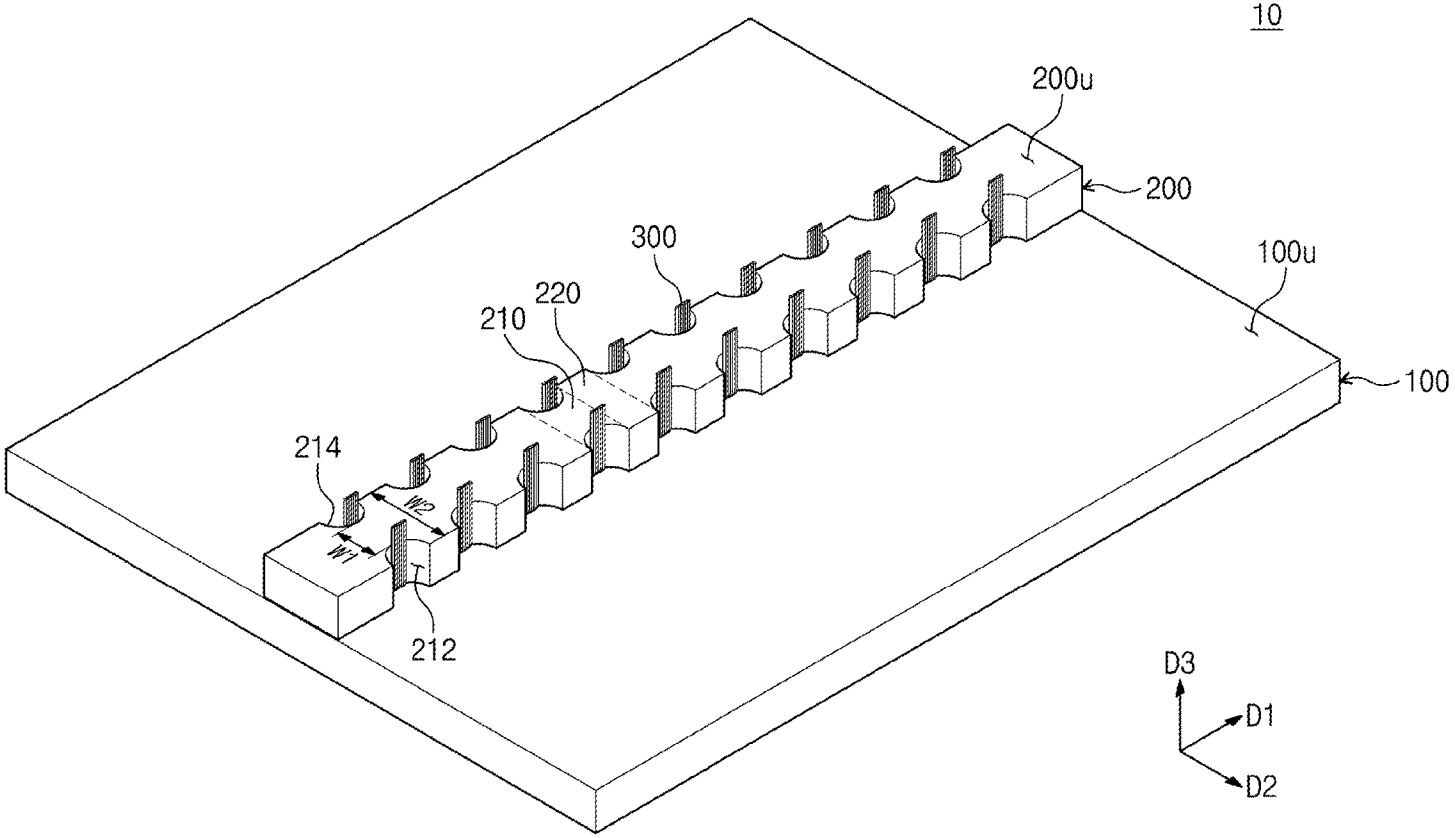
FIG. 1 is a perspective view of an electron emission source according to exemplary embodiments of the inventive concept.

In order to fully understand the configuration and effects of the technical spirit of the inventive concept, preferred embodiments of the technical spirit of the inventive concept will be described with reference to the accompanying drawings. However, the technical spirit of the inventive concept is not limited to the embodiments set forth herein and may be implemented in various forms and various modifications may be applied thereto. Only, the technical spirit of the inventive concept is disclosed to the full through the description of the embodiments, and it is provided to those skilled in the art that the inventive concept belongs to inform the scope of the inventive concept completely.

Like reference numerals refer to like elements throughout the specification. Embodiments described in this specification will be described with perspective views and/or conceptual views, that is, ideal exemplary views of the inventive concept. In the drawings, the thicknesses of areas are exaggerated for effective description. Areas exemplified in the drawings have general properties, and are used to illustrate a specific shape of a semiconductor package region. Thus, this should not be construed as limited to the scope of the inventive concept. It will be understood that various terms are used herein to describe various components but these components should not be limited by these terms. These terms are just used to distinguish a component from another component. Embodiments described herein include complementary embodiments thereof.

The terms used in this specification are used only for explaining specific embodiments while not limiting the inventive concept. The terms of a singular form may include plural forms unless referred to the contrary. The meaning of "comprises," and/or "comprising" in this specification specifies the mentioned component but does not exclude at least one another component.

Hereinafter, preferred embodiments of the technical spirit of the inventive concept are described with reference to the accompanying drawings so that the inventive concept is described in more detail.

FIG. 1 is a perspective view of an electron emission source according to exemplary embodiments of the inventive concept.

Referring to FIG. 1, an electron emission source 10 including a substrate 100 may be provided. In exemplary embodiments, the electron emission source 10 may emit electrons in an electric field. The electron emission source 10 may be referred to as an electric field electron emission source or an electric field electron emitter. The substrate 100 may be a conductive substrate. For example, the substrate 100 may include a metal or a doped semiconductor material.

The fixed structure 200 may be provided on the substrate 100. The fixed structure 200 may extend in a first direction D1 parallel to the upper surface 100*u* of the substrate 100. The fixed structure 200 may have a width parallel to the upper surface 100*u* of the substrate 100 but along a second direction D2 intersecting the first direction D1. The fixed structure 200 includes a first portion 210 having a first minimum width W1 and a pair of second portions 220 having a second minimum width W2 greater than the first minimum width W1. The pair of second portions 220 may be spaced apart from each other in the first direction D1 with the first portion 210 therebetween. That is, the first portion 210 may be disposed between the pair of second portions 220.

A plurality of first portions 210 and a plurality of second portions 220 may be alternately arranged along the first direction D1. The plurality of first portions 210 may be arranged apart from each other in the first direction D1. The spacing distances between the plurality of first portions 210 may be substantially equal to each other. However, this is an exemplary one.

The first portion 210 may include a first sidewall 212 and a second sidewall 214 facing the opposite directions each other in the second direction D2. The first and second sidewalls 212 and 214 of the first portion 210 may have a concave shape. A distance along the second direction D2 between the first and second sidewalls 212 and 214 of the first portion 210 is less than a distance along the second direction D2 between the sidewalls of each of the pair of second portions 220. Each of the first and second sidewalls 212 and 214 of the first portion 210 may have a shape corresponding to the side of a cylinder. That is, each of the first and second sidewalls 212 and 214 of the first portion 210 may have a semicircular arc shape from the plan viewpoint, and may extend in a third directions D3 perpendicular to the upper surface 100*u* of the substrate 100. However, the above disclosure for the shapes of the first and second sidewalls 212 and 214 of the first portion 210 is exemplary and not limited.

The fixed structure 200 may include a conductive material. For example, the fixed structure 200 may include a metal or a doped semiconductor material. A conductive adhesive material (not shown) may be provided between the fixed structure 200 and the substrate 100. For example, the conductive adhesive material may include a nano-metal material or a brazing filler. The fixed structure 200 may be fixed on the substrate 100 through the conductive adhesive material. However, this is illustrative and not limited. That is, the fixed structure 200 may be fixed on the substrate 100 through a screw (not shown) penetrating the fixed structure 200 and extending into the substrate 100.

Electron emission yarns 300 may be provided on the first and second sidewalls 212 and 214 of the first portion 210 of the fixed structure 200. Like the plurality of first portions 210, the electron emission yarns 300 may be arranged along the first direction D1. As provided in an electric field, the electron emission yarns 300 may emit electrons. Although six electron emission yarns 300 are shown on the first and second sidewalls 212 and 214 of the first portion 210, this is exemplary. That is, in other exemplary embodiments, less than or more than six electron emission yarns 300 may be provided. Each of the electron emission yarns 300 may extend along each of the first and second sidewalls 212 and 214 of the first portion 210. For example, the electron emission yarns 300 may extend substantially in the third direction D3 on the first and second sidewalls 212 and 214 of the first portion 210. In exemplary embodiments, the electron emission yarns 300 may protrude from the upper surface 200*u* of the fixed structure 200. For example, the electron emission yarns 300 may protrude from the upper surface 200*u* of the fixed structure 200 in the third direction D3. The end portion of each of the electron emission yarns 300 may be disposed higher than the upper surface 200*u* of the fixed structure 200. The end portions of the electron emission yarns 300 may have substantially the same height. Accordingly, it is possible to control the electron emission of the electron emission yarns 300 by controlling the electric field size. The electron emission yarns 300 on the first sidewall 212 of the first portion 210 extend between the fixed structure 200 and the substrate 100 to be connected to the electron emission yarns 300 on the second sidewall 214 of the first portion 210, respectively. The electron emission yarns 300 may be fixed by the fixed structure 200 and the substrate 100. That is, the fixed structure 200 and the substrate 100 may apply pressure to the electron emission yarns 300 to fix the electron emission yarns 300. The electron emission yarns 300 may include a conductive nanomaterial. For example, the electron emission yarns 300 may include carbon nanotube yarns.

Generally, the electron emission source may include nanowires or nanotubes grown directly on a substrate. The nanowires or nanotubes are structurally unstable and may fall during operations of the electron emission source.

The lower portions of the electron emission yarns 300 according to exemplary embodiments of the inventive concept may be fixed by the substrate 100 and the fixed structure 200. Also, when the electron emission yarns 300 are tilted toward the fixed structure 200, they may be supported by the fixed structure 200 and may not collapse. That is, the stability of the electron emission yarns 300 may be maximized.

Since the electron emission yarns 300 according to exemplary embodiments of the inventive concept are provided on the first and second sidewalls 212 and 214 of the first portions 210 of the fixed structure 200, the positions of the first portions 210 of the fixed structure 200 may be adjusted to position the electron emission yarns 300 at desired positions.

Figure 2:
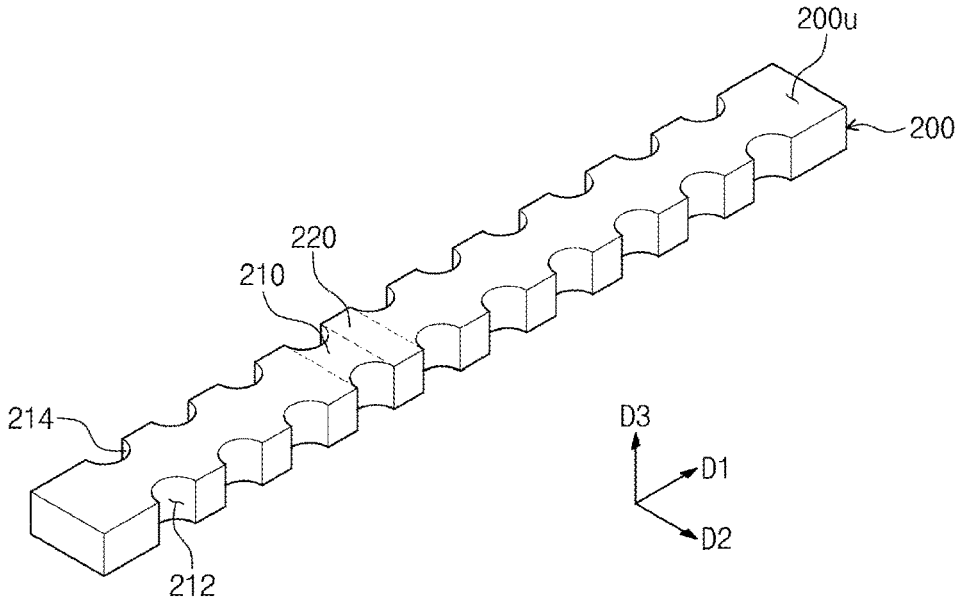
FIGS. 2 to 4 are perspective views of an electron emission source according to exemplary embodiments of the inventive concept.
Figure 3:
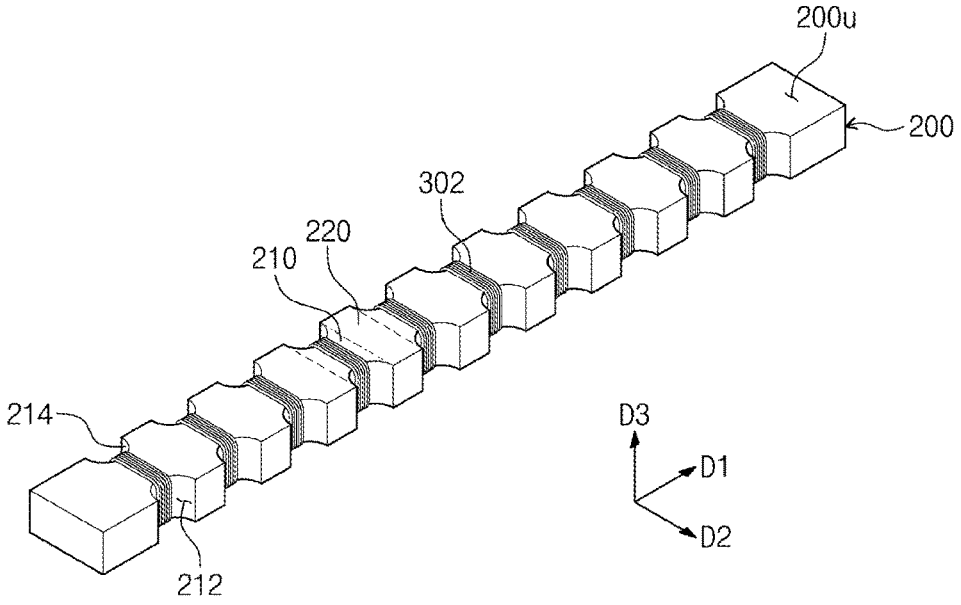
Figure 4:
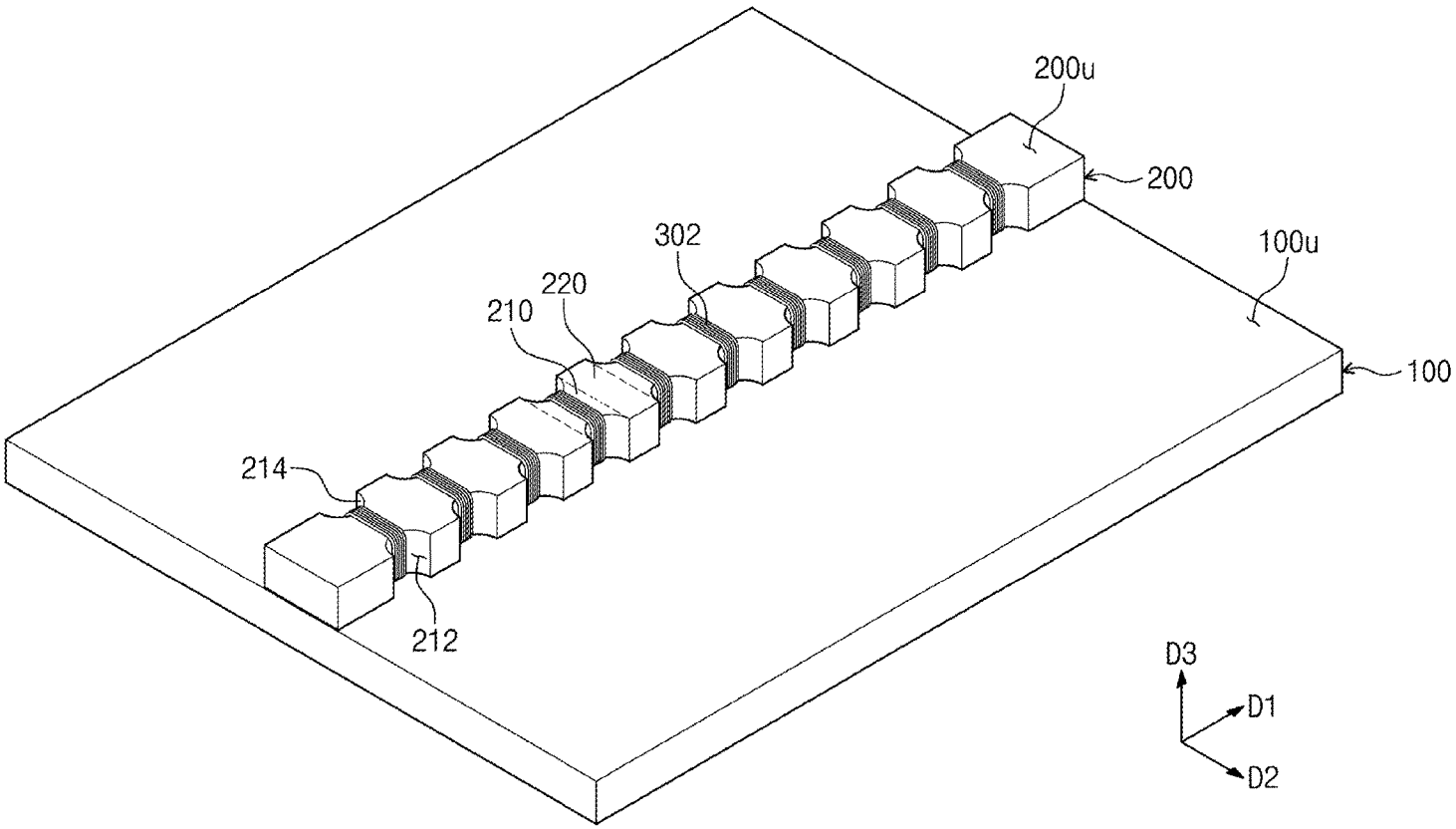

FIGS. 2 to 4 are perspective views illustrating a method of manufacturing an electron emission source according to exemplary embodiments of the inventive concept. For conciseness of description, contents substantially identical to the contents described with reference to FIG. 1 are not described.

Referring to FIG. 2, a fixed structure 200 including a first portion 210 and a second portion 220 may be prepared. The fixed structure 200 may be substantially the same as the fixed structure 200 described with reference to FIG. 1. The fixed structure 200 may include a conductive material. For example, the fixed structure 200 may include a metal or a doped semiconductor material.

Referring to FIG. 3, a preliminary electron emission yarn 302 may be formed on the first portion 210 of the fixed structure 200. Forming the preliminary electron emission yarn 302 may include winding the first portion 210 of the fixed structure 200 into the preliminary electron emission yarn 302. The preliminary electron emission yarn 302 may surround the first and second sidewalls 212 and 214, the upper surface 200*u*, and the bottom surface (not shown) of the first portion 210 of the fixed structure 200. Although the preliminary electron emission yarn 302 winds the first portion 210 of the fixed structure 200 six times, this is exemplary. That is, in other exemplary embodiments, the number of times that the preliminary electron emission yarn 302 is wound may be less than or greater than six times.

In exemplary embodiments, the fixed structure 200 may be wound by one preliminary electron emission yarn 302. For example, one preliminary electron emission yarn 302 may extend in a first direction D1 and wind each of the first portions 210 a plurality of times in a clockwise or counterclockwise direction. In exemplary embodiments, one preliminary electron emission yarn 302 may be provided on the first portions 210 of the fixed structure 200. That is, the first portions 210 of the fixed structure 200 may be wound by one preliminary electron emission yarn 302. A portion of the preliminary electron emission yarn 302 is provided on the bottom surface of the second portion 220 of the fixed structure 200 to connect other portions of the preliminary electron emission yarns 302 provided on the first portions 210 immediately adjacent to each other. That is, the preliminary electron emission yarn 302 may be wound on one of the first portions 210 of the fixed structure 200 and extend on the bottom surface of the second portion 220 to be wound on another one of the first portions 210. One and another one of the first portions 210 of the fixed structure 200 may be immediately adjacent to each other and the second portion 220 may be disposed between one and another one of the first portions 210.

In exemplary embodiments, a plurality of preliminary electron emission yarn 302 may be provided on the first portions 210 of the fixed structure 200. For example, the plurality of preliminary electron emission yarns 302 may wind each of the first portions 210 of the fixed structure 200. That is, the plurality of preliminary electron emission yarns 302 immediately adjacent to each other may not be connected to each other.

Referring to FIG. 4, the fixed structure 200 in which the preliminary electron emission yarn 302 is wound may be fixed on the substrate 100. In exemplary embodiments, the fixed structure 200 and the substrate 100 may be bonded to each other through a conductive bonding material (not shown) provided between the fixed structure 200 and the substrate 100 and may be fixed. For example, the conductive bonding material may include a nano-metal material or a brazing filler. However, fixing the fixed structure 200 on the substrate 100 is not limited to the above disclosure. In other exemplary embodiments, the fixed structure 200 may be fixed on the substrate 100 using screws (not shown) penetrating the fixed structure 200 to be provided in the substrate 100.

When the fixed structure 200 is fixed on the substrate 100, the preliminary electron emission yarn 302 wound on the fixed structure 200 may be fixed together. In exemplary embodiments, the conductive bonding material is provided between the preliminary electron emission yarn 302 and the substrate 100 provided on the bottom surface of the fixed structure 200 so that it may fix the preliminary electron emission yarn 302. In exemplary embodiments, the preliminary electron emission yarn 302 is interposed between the fixed structure 200 and the substrate 100 so that it may be fixed between the fixed structure 200 and the substrate 100.

Referring again to FIG. 1, the electron emission yarns 300 may be formed. Forming the electron emission yarns 300 may include cutting the preliminary electron emission yarn 302 of FIG. 4 on the upper surface 200*u* of the fixed structure 200 and erecting the electron emission yarns 300 in the third direction D3. The preliminary electron emission yarn 302 may be cut so that the lengths of the electron emission yarns 300 on the upper surface 200*u* of the fixed structure 200 are substantially equal to each other. For example, the preliminary electron emission yarn 302 may be cut along the center of the upper surface 200*u* of the fixed structure 200 in a first direction D1. For example, cutting the preliminary electron emission yarn 302 may include a laser or knife cutting process.

In exemplary embodiments, the process of erecting the electron emission yarns 300 may include a surface treatment process using an adhesive roller (not shown). For example, as the adhesive roller passes over the upper surface 200*u* of the fixed structure 200, it adheres to and falls off the electron emission yarns 300, so that the electron emission yarns 300 may be erected. Accordingly, as shown in FIG. 1, the electron emission yarns 300 may extend in the third direction D3.

In general, since electron emission yarn is provided on a substrate through a direct growth process or an adhesion process, a long process time and a high process cost may be required. The electron emission yarn 300 according to exemplary embodiments of the inventive concept is formed through the process of winding the preliminary electron emission yarn 302 on the fixed structure 200 and cutting it, so that a process time and a process cost may be minimized.

Figure 5A:
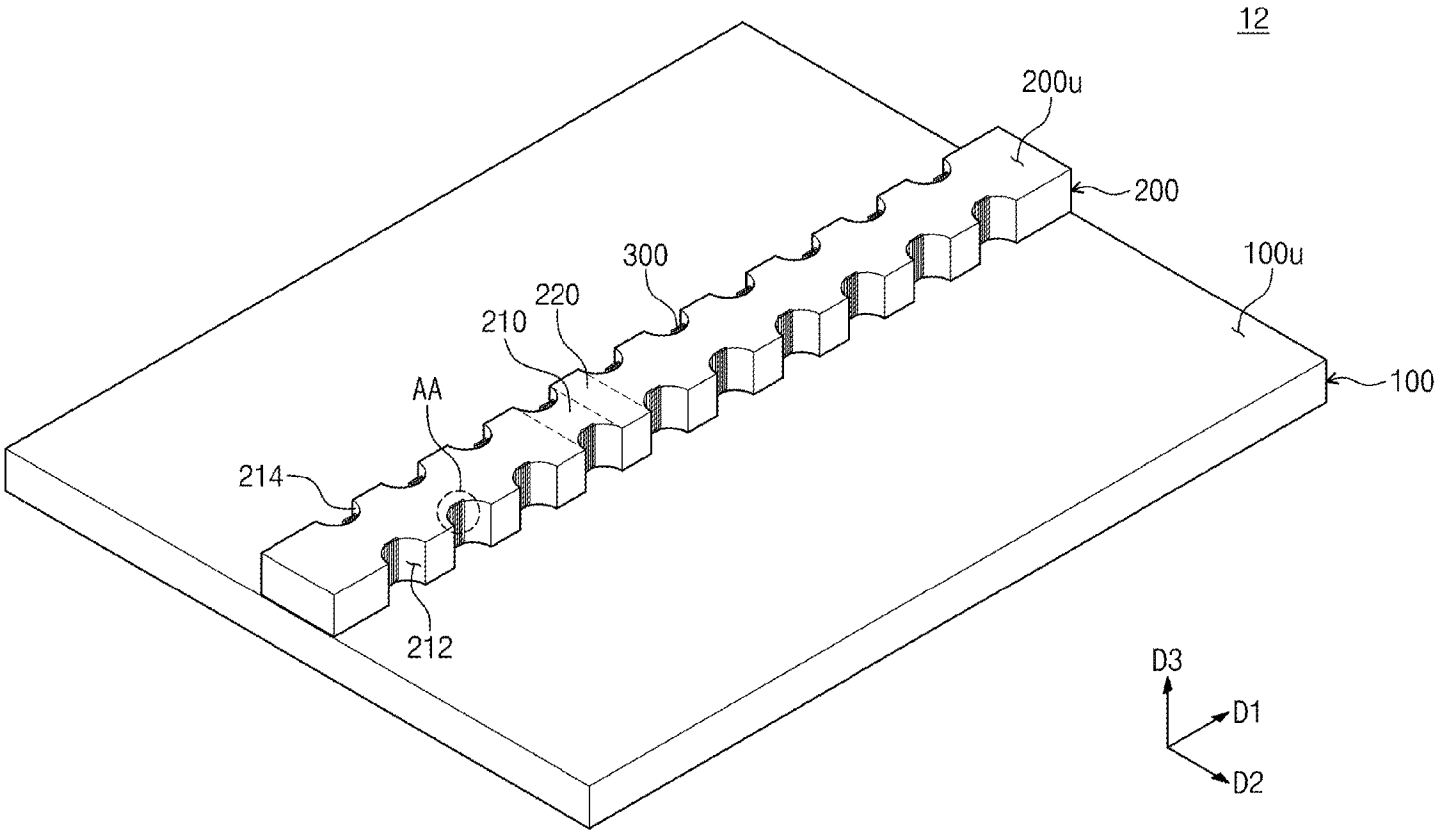
FIG. 5A is a perspective view of an electron emission source according to exemplary embodiments of the inventive concept.
Figure 5B:
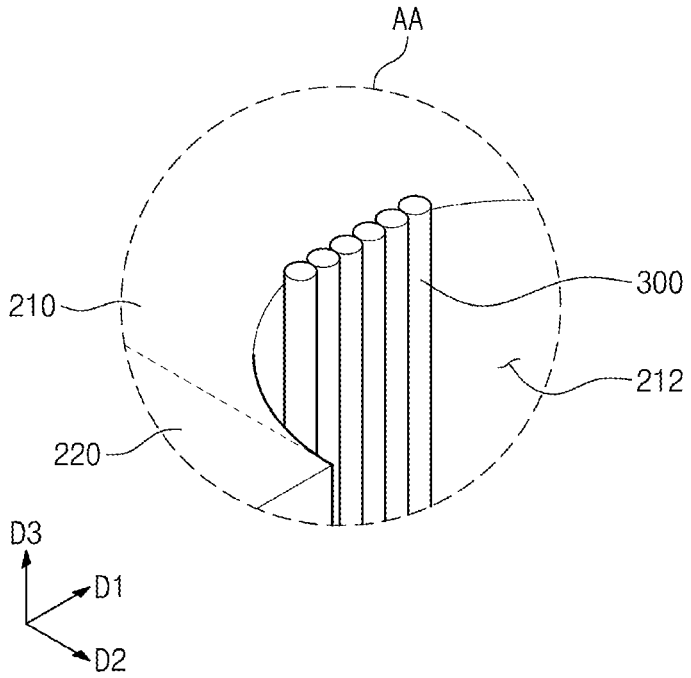
FIG. 5B is a perspective view illustrating a method for manufacturing an electron emission source according to exemplary embodiments of the inventive concept.

FIG. 5A is a perspective view of an electron emission source according to exemplary embodiments of the inventive concept. FIG. 5B is an enlarged view of a portion AA of FIG. 5A. For conciseness of description, contents substantially identical to the contents described with reference to FIGS. 1 to 4 are not described.

Referring to FIGS. 5A and 5B, an electron emission source 12 including a substrate 100, a fixed structure 200, and electron emission yarns 300 may be provided. The substrate 100 and the fixed structure 200 may be substantially the same as those described with reference to FIG. 1. The electron emission yarns 300 may be substantially the same as those described with reference to FIG. 1, except for the degree of protrusion from the upper surface 200*u* of the fixed structure 200.

The electron emission yarns 300 may protrude from the upper surface 200*u* of the fixed structure 200. The end portions of the electron emission yarns 300 may protrude less from the upper surface 200*u* of the fixed structure 200 than the end portions of the electron emission yarns 300 described with reference to FIG. 1. That is, the end portions of the electron emission yarns 300 may be closer to the upper surface 200*u* of the fixed structure 200 than the end portions of the electron emission yarns 300 described with reference to FIG. 1. For example, the electron emission yarns 300 may protrude from several nanometers (nm) to several micrometers (μm) from the upper surfaces 200*u* of the fixed structure 200.

The manufacturing method of the electron emission source 12 according to this embodiment may be substantially the same as the manufacturing method of the electron emission source 10 described with reference to FIGS. 1 to 4 except for the cutting position of the preliminary electron emission yarn 302 (see FIG. 4). In the following, the cutting position of the preliminary electron emission yarn 302 (see FIG. 4) is described.

Unlike one described with reference to FIG. 1, the preliminary electron emission yarn 302 (see FIG. 4) may be cut in the first direction D1 along a plurality of cut lines (not shown) on the upper surface 200*u* of the fixed structure 200. For example, the preliminary electron emission yarn 302 (see FIG. 4) may be cut on both end portions along the second direction D2 of the first portion 210 of the fixed structure 200. Accordingly, the preliminary electron emission yarn 302 (see FIG. 4) on the upper surface 200*u* of the fixed structure 200 may be removed.

Figure 6:
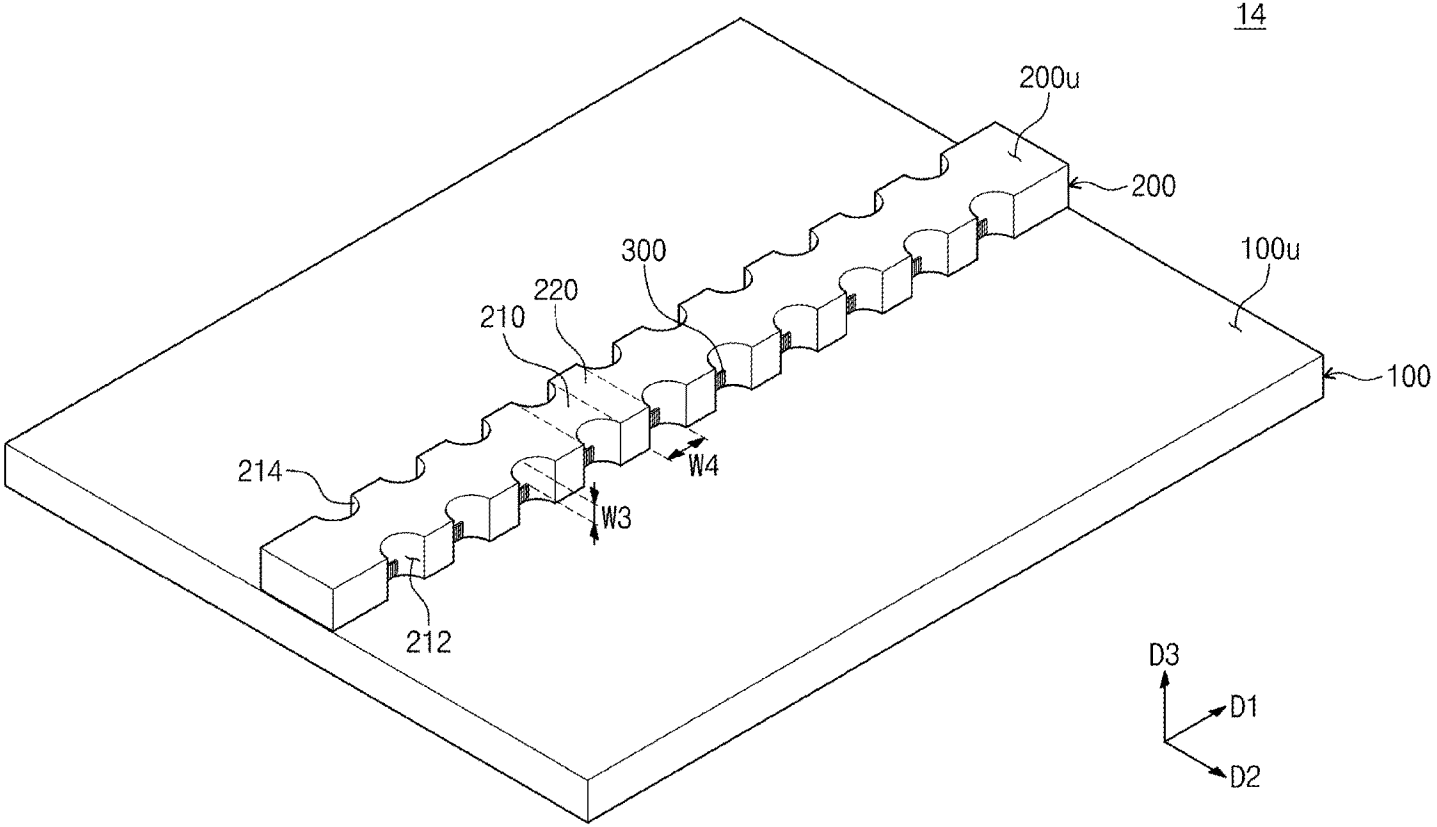
FIG. 6 is a perspective view of an electron emission source according to exemplary embodiments of the inventive concept.

FIG. 6 is a perspective view of an electron emission source according to exemplary embodiments of the inventive concept. For conciseness of description, contents substantially identical to the contents described with reference to FIGS. 1 to 4 are not described.

Referring to FIG. 6, an electron emission source 14 including a substrate 100, a fixed structure 200, and electron emission yarns 300 may be provided. The substrate 100 and the fixed structure 200 may be substantially the same as those described with reference to FIG. 1.

The end portions of the electron emission yarns 300 may be disposed at a position lower than the upper surface 200*u* of the fixed structure 200. For example, the end portions of the electron emission yarns 300 may be disposed at a position lowered by the diameter W4 of the first sidewall 212 from the upper surface 200*u* of the fixed structure 200. That is, a spacing distance W3 between the end portions of the electron emission yarns 300 and the upper surface 200*u* of the fixed structure 200 may be substantially equal to the diameter W4 of the first sidewall 212. When a voltage is applied to the substrate 100, the fixed structure 200, and the electron emission yarns 300, a concave equipotential surface may be formed on the electron emission yarns 300. Thus, the electron beam emitted from the electron emission yarns 300 may be efficiently focused.

Figure 7:
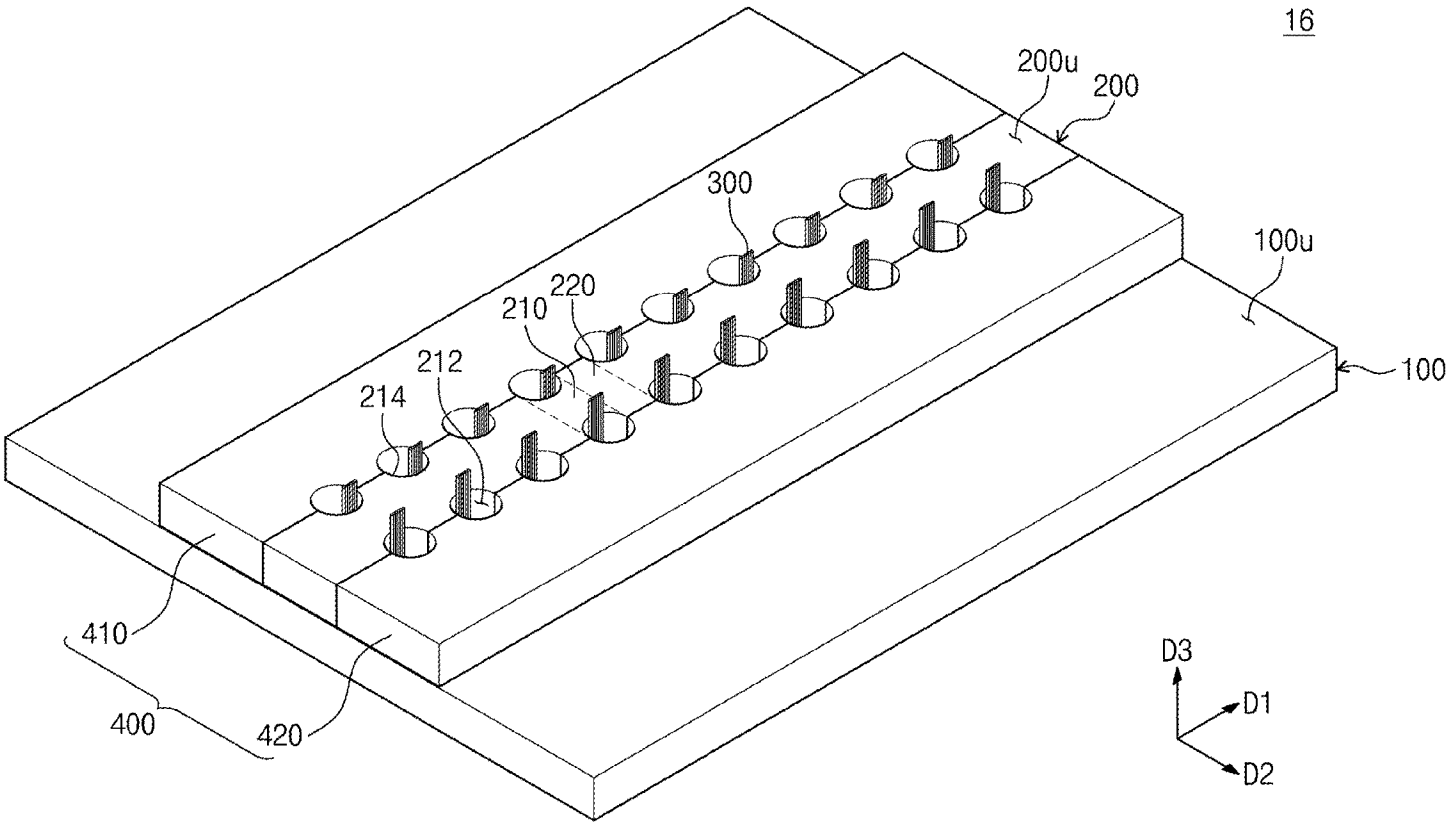
FIG. 7 is a perspective view of an electron emission source according to exemplary embodiments of the inventive concept.

FIG. 7 is a perspective view of an electron emission source according to exemplary embodiments of the inventive concept. For conciseness of description, contents substantially identical to the contents described with reference to FIG. 1 are not described.

Referring to FIG. 7, an electron emission source 16 including a substrate 100, a fixed structure 200, and electron emission yarns 300 may be provided. The substrate 100, the fixed structure 200, and the electron emission yarns 300 may be substantially the same as those described with reference to FIG. 1.

A support structure 400 may be provided on both sidewalls of the fixed structure 200. The support structure 400 may include a first support structure 410 and a second support structure 420 spaced apart from each other in a second direction D2 with the fixed structure 200 therebetween. However, this is an exemplary one. In other exemplary embodiments, the support structure 400 may include a first support structure 410 or a second support structure 420. Each of the first and second support structures 410 and 420 may extend in a first direction D1. A length along the first direction D1 of each of the first and second support structures 410 and 420 may be substantially the same as a length along the first direction D1 of the fixed structure 200. The first support structure 410 may have a concave sidewall facing the second sidewall 214 of each of the first portions 210 of the fixed structure 200. The second support structure 420 may have a concave sidewall facing the first sidewall 212 of each of the first portions 210 of the fixed structure 200. However, this is an exemplary one. That is, in other exemplary embodiments, the first and second support structures 410 and 420 may not have concave sidewalls. The first and second support structures 410 and 420 may support the electron emission yarns 300 so that they do not collapse. Accordingly, even if the electron emission yarns 300 are inclined, the end portions of the electron emission yarns 300 may protrude onto the upper surface 200*u* of the fixed structure 200.

Figure 8:
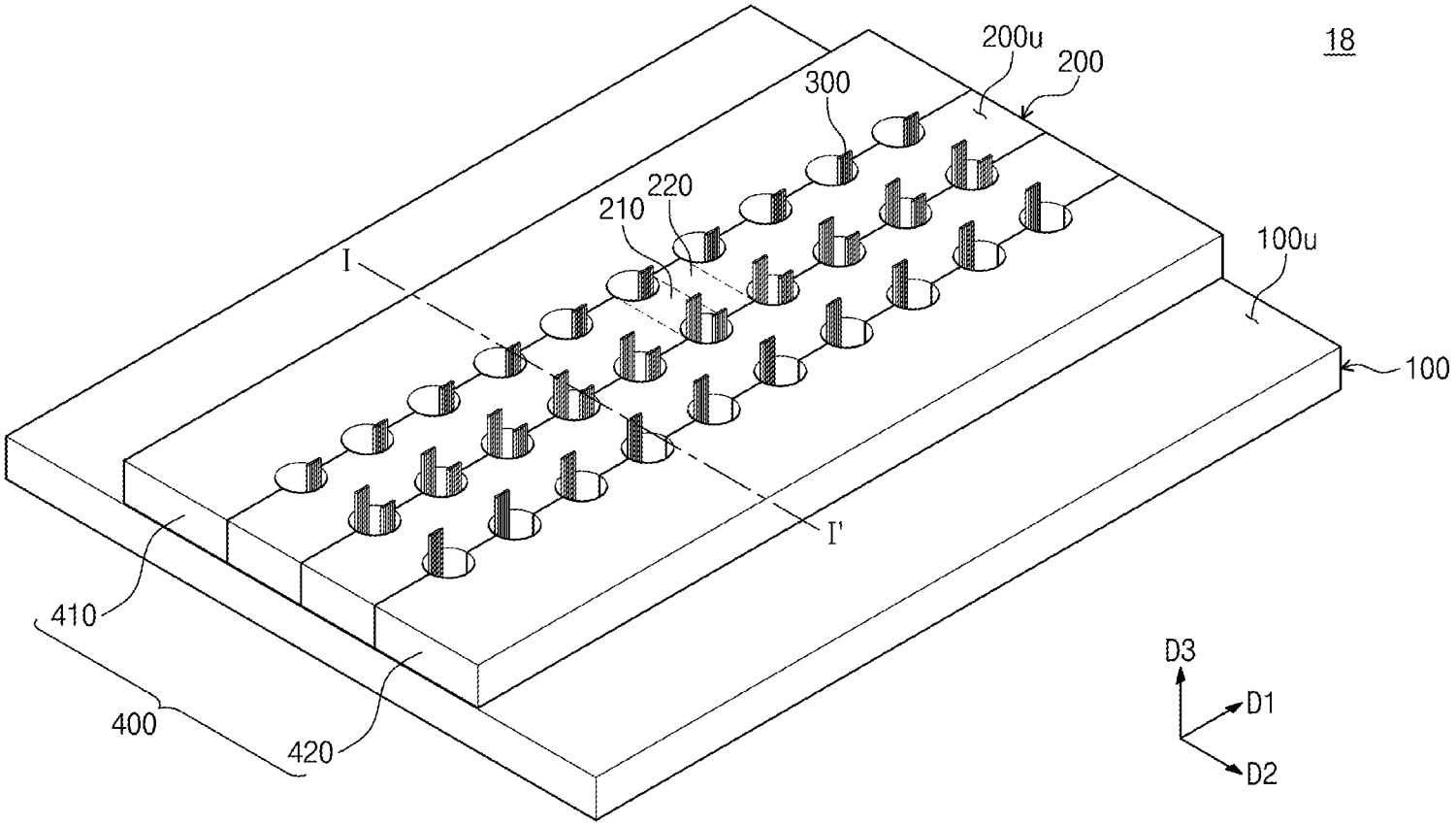
FIG. 8 is a perspective view of an electron emission source according to exemplary embodiments of the inventive concept.

FIG. 8 is a perspective view of an electron emission source according to exemplary embodiments of the inventive concept. For conciseness of description, contents substantially identical to the contents described with reference to FIG. 7 are not described.

Referring to FIG. 8, an electron emission source 18 including a substrate 100, fixed structures 200, electron emission yarns 300, and a support structure 400 may be provided. Except for the number of the fixed structures 200 and the electron emission yarns 300, the electron emission source 18 of this embodiment may be substantially the same as the electron emission source 16 described with reference to FIG. 7.

Unlike FIG. 7, a plurality of fixed structures 200 may be provided. For conciseness of description, two fixed structures 200 are exemplarily shown. In other exemplary embodiments, two or more fixed structures 200 may be provided. The plurality of fixed structures 200 may be arranged along the second direction D2. The first and second portions 210 and 220 of one of the fixed structures 200 immediately adjacent to each other are arranged in the second direction D2 with the first and second portions 210 and 220 of another one. The electron emission yarns 300 may be provided between the sidewalls of the first portions 210 of each of the plurality of fixed structures 200. Accordingly, more electron emission yarns 300 may be provided than when the fixed structure 200 is one.

Figure 9:
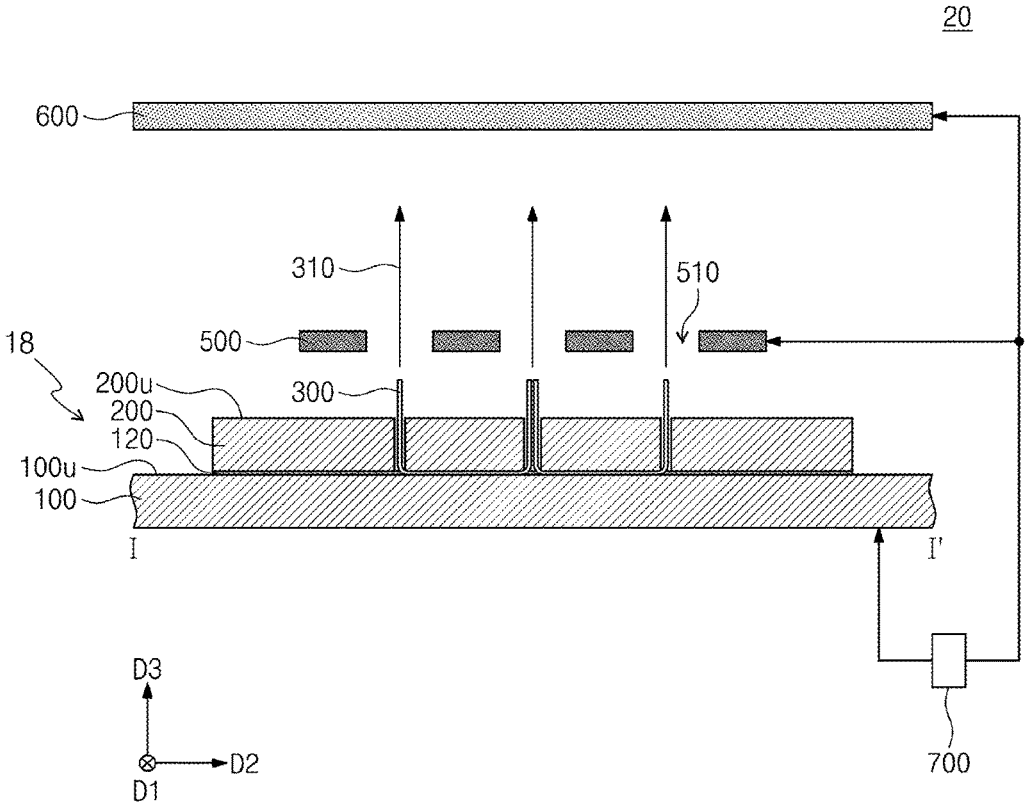
FIG. 9 is a perspective view of an electron emission device according to exemplary embodiments of the inventive concept.

FIG. 9 is a conceptual diagram of an electron emission device according to exemplary embodiments of the inventive concept. The drawing for the electron emission source 18 in FIG. 9 corresponds to the sectional view taken along the line I-I' in FIG. 8. For conciseness of description, contents substantially identical to the contents described with reference to FIGS. 1 to 8 are not described.

Referring to FIG. 9, an electron emission device 20 including an electron emission source 18, a gate substrate 500, an anode substrate 600, and a power source unit 700 may be provided.

Although the electron emission device 20 including the electron emission source 18 of FIG. 8 is shown, this is exemplary. In other exemplary embodiments, the electron emission device 20 may include the electron emission sources 10, 12, 14, and 16 of FIG. 1, 5A, 6, or 7 instead of the electron emission source 18 of FIG. 18.

The electron emission source 18 may include a substrate 100, a fixed structure 200, and electron emission yarns 300. The substrate 100, the fixed structure 200, and the electron emission yarns 300 may be substantially the same as those described with reference to FIG. 8. The substrate 100 may be a cathode substrate.

A conductive adhesive material 120 may be provided between the substrate 100 and the fixed structure 200. The conductive adhesive material 120 may be substantially the same as the conductive adhesive material described with reference to FIG. 1.

A gate substrate 500 may be provided on the fixed structure 200. The gate substrate 500 and the fixed structure 200 may be spaced apart from each other in the third direction D3. The gate substrate 500 may extend in a direction parallel to the upper surface 100*u* of the substrate 100. The gate substrate 500 and the electron emission source 18 may be parallel to each other and may face each other. The gate substrate 500 may include gate holes 510 therein. From the plan viewpoint, the electron emission yarns 300 may be disposed in the gate holes 510. Accordingly, the electrons 310 emitted from the electron emission yarns 300 may pass through the gate holes 510. The gate substrate 500 may include a conductive material (e.g., a metal).

The anode substrate 600 may be provided on the gate substrate 500. The anode substrate 600 and the gate substrate 500 may be spaced apart from each other in the third direction D3. The anode substrate 600 and the gate substrate 500 may be parallel to each other. Accordingly, the anode substrate 600, the gate substrate 500, and the electron emission source 18 may be parallel to each other. The anode substrate 600 may include a conductive material (e.g., a metal).

The power source unit 700 may generate a potential difference between the substrate 100 and the gate substrate 500 and between the substrate 100 and the anode substrate 600. The potentials of the gate substrate 500 and the anode substrate 600 may be higher than the potential of the substrate 100. The potential difference between the anode substrate 600 and the substrate 100 may be greater than the potential difference between the gate substrate 500 and the substrate 100.

Hereinafter, the operation of the electron emission device will be described with reference to FIG. 9. When the power source unit 700 generates a potential difference between the substrate 100 and the gate substrate 500 and between the substrate 100 and the anode substrate 600, electrons 310 may be emitted toward the gate substrate 500 from the end portion of the electron emission yarns 300. The electrons 310 emitted from the electron emission yarns 300 may reach the anode substrate 600 as passing through the gate holes 510 in the gate substrate 500. At this time, the electrons 310 may be accelerated by the electric field between the substrate 100 and the gate substrate 500 and between the gate substrate 500 and the anode substrate 600. The electric field may be formed by a potential difference generated by the power source unit 700.

In general, the structural stability of the electron emission yarn may not be maintained when the electron emission yarn is placed in a large electric field. An electron emission yarn according to exemplary embodiments of the inventive concept may have its lower portion fixed by a fixed structure and a substrate. According to embodiments, a support structure may be provided to prevent an electron emission yarn from collapsing to a side surface. Thus, the stability of an electron emission yarn may be maintained.

In general, since electron emission yarn is provided on a substrate through a direct growth process or an adhesion process, a long process time and a high process cost may be required. An electron emission yarn according to exemplary embodiments of the inventive concept is formed through the process of winding a preliminary electron emission yarn on a fixed structure and cutting it, so that a process time and a process cost may be minimized.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. An electron emission source comprising:

a substrate;

a fixed structure provided on the substrate and including at least one first portion and at least one second portion that are laterally arranged in a first direction, the first direction being parallel to a top surface of the substrate; and an electron emission yarn provided on the substrate and including a first part and a second part, wherein the first portion has a first width in a second direction and the second portion has a second width in the second direction, the second width being greater than the first width, the second direction being parallel to the top surface of the substrate and crossing the first direction, wherein the first part of the electron emission yarn is provided between the substrate and the first portion of the fixed structure, and wherein the second part of the electron emission yarn extends, along a third direction that is perpendicular to the top surface of the substrate, on a first one of two sidewalls of the first portion of the fixed structure from the first part of the electron emission yarn, the two sidewalls of the first portion facing each other in the second direction.

2. The electron emission source of claim 1, wherein the second part of the electron emission yarn protrudes from a top surface of the fixed structure.

3. The electron emission source of claim 2, wherein the second part of the electron emission yarn protrudes by several nanometers to several micrometers from the top surface of the fixed structure.

4. The electron emission source of claim 1, wherein the electron emission yarn further includes a third part, the third part of the electron emission yarn extends, along the third direction, on a second one of the two sidewalls of the first portion from the first part of the electron emission yarn.

5. The electron emission source of claim 1, wherein the electron emission yarn comprises a plurality of electron emission yarns having end portions extending, along the third direction, from the first part of the electron emission yarn, the end portions having the same heights.

6. The electron emission source of claim 1, wherein the fixed structure comprises a plurality of first portions and a plurality of second portions, and the plurality of first portions and the plurality of second portions are alternately arranged in the first direction.

7. The electron emission source of claim 6, wherein the electron emission source comprises a plurality of fixed structures, and the plurality of fixed structures are arranged in the second direction.

8. The electron emission source of claim 7, further comprising support structures provided on a side surface of each of fixed structures disposed outmost along the second direction among the plurality of fixed structures, wherein the support structures are arranged in the second direction together with the plurality of fixed structures.

9. The electron emission source of claim 1, wherein the electron emission yarn has an end portion extending, along the third direction, from the first part of the electron emission yarn, and the end portion is disposed lower than a top surface of the fixed structure.

10. The electron emission source of claim 1, wherein the electron emission yarn is provided to surround the two sidewalls, a top surface, and a bottom surface of the first portion of the fixed structure.

* * * * *